US005336111A

United States Patent [19]

Thrush et al.

[11] Patent Number: 5,336,111

[45] Date of Patent: Aug. 9, 1994

[54] BOARDLOCK FOR AN ELECTRICAL CONNECTOR

[75] Inventors: Roger L. Thrush, Clemmons, N.C.; Richard C. Tan, Singapore, Singapore; James R. Lambert, Kernersville, N.C.

[73] Assignee: The Whitaker Corporation, Wilmington, Del.

[21] Appl. No.: 127,677

[22] Filed: Sep. 28, 1993

[51] Int. Cl.[5] ..... H01R 13/73

[52] U.S. Cl. ..... 439/567

[58] Field of Search ..... 439/82, 553, 557, 567, 439/571, 751

[56] References Cited

U.S. PATENT DOCUMENTS

| | | | |
|---|---|---|---|
| D. 299,004 | 12/1988 | Fujimoto | D8/382 |
| 3,492,627 | 1/1970 | Tauscher | 439/82 |
| 3,577,603 | 5/1971 | Seckerson et al. | 24/73 |
| 3,778,755 | 12/1973 | Marks | 439/853 |
| 4,495,548 | 1/1985 | Matsui | 361/413 |
| 4,693,532 | 9/1987 | Colleran et al. | 439/594 |
| 4,907,987 | 3/1990 | Douty et al. | 439/571 |
| 5,074,807 | 12/1991 | Parmer | 439/553 |
| 5,135,412 | 8/1992 | Sitzler | 439/567 |
| 5,145,407 | 9/1992 | Obata et al. | 439/567 |
| 5,145,408 | 9/1992 | Houtteman et al. | 439/581 |
| 5,154,634 | 10/1992 | Brown et al. | 439/553 |
| 5,161,999 | 11/1992 | Broschard, III et al. | 439/567 |
| 5,163,851 | 11/1992 | Hart et al. | 439/567 |
| 5,171,165 | 12/1992 | Hwang | 439/567 |

FOREIGN PATENT DOCUMENTS 40-22823 8/1965 Japan .

*Primary Examiner*—Gary F. Paumen

*Attorney, Agent, or Firm*—Robert J. Kapalka

[57] ABSTRACT

A boardlock for holding a socket to a circuit board comprises an integral body including a main beam, a socket retention section adapted to self-retain to the socket, and a circuit board retention section engageable in a hole in the circuit board. The circuit board retention section is substantially flat and, together with at least the main beam, defines a plane. The circuit board retention section includes a pair of spaced apart legs extending in the plane from the main beam to a common remote end defined by a tie bar. The legs are dimensioned to extend beyond an exit of the hole at a far side of the circuit board. Portions of the legs are divergently angled as they extend to a widest dimension of the circuit board retention section. The widest dimension is chosen to be wider than a widest dimension of the hole exit in the circuit board, and to be spaced from the main beam by a distance greater than a thickness of the circuit board at a periphery of the hole exit. Further portions of the legs are convergently angled as they extend from the widest dimension to the remote end. The structural arrangement of the circuit board retention section makes it compliant substantially exclusively in the direction of the plane, and the divergently angled leg portions are spring biased against the periphery of the hole exit through a range of board thickness and hole diameter variations.

8 Claims, 6 Drawing Sheets

BOARDLOCK FOR AN ELECTRICAL CONNECTOR

FIELD OF THE INVENTION

The invention is related to the field of devices for removably securing an electrical connector to a circuit board.

BACKGROUND OF THE INVENTION

Single in-line memory module (SIMM) sockets are well-known devices for interconnecting printed circuit boards (PCB's). The SIMM sockets have an elongated channel and a plurality of electrical contacts extending into the channel along its length. An edge of one PCB (the daughterboard) is insertable into the channel, whereby circuit edge pads of the daughterboard are engaged by the contacts of the SIMM socket. The contacts have leads which extend below a bottom surface of the SIMM socket for electrical connection with circuit paths on a mating PCB (the motherboard). Such electrical connection may be by lead posts which extend through plated through-holes in the motherboard, or by surface mount leads which engage and are connected to contact pads on the motherboard in a soldering operation. With either through-hole or surface mount leads, alignment of the leads with their respective circuit paths on the motherboard is critical.

A SIMM socket is typically retained to the motherboard by one or more plastic retention posts which are integral with and extend from a bottom of the socket. These retention posts are dimensioned to resiliently engage in holes in the motherboard. Due to the inability of circuit board manufacturers to maintain close tolerances on circuit board thickness and hole diameter, it is difficult to consistently achieve secure retention and precise alignment of the SIMM socket on the PCB. This is particularly a problem with SIMM sockets having surface mount contacts, because the leads of these contacts must be in abutting engagement with their respective contact pads on the motherboard in order that the leads can be soldered to the contact pads. If the circuit board thickness and hole diameter are not held to close tolerances, the SIMM socket may be loosely held on the circuit board.

A particular problem arises in the case of SIMM sockets having through-hole leads which are wave soldered to the motherboard. The motherboard is heated on the underside away from the socket and, because of thermal expansion, the board pulls away from the socket creating a gap between the board and the socket. The solder freezes while this relative condition exists and, when the board cools and returns to thermal equilibrium, the board imparts a bow in the socket such that a gap is created between a central portion of the socket and the board. What is needed is a retention device that will firmly hold a SIMM socket to a circuit board despite thermal stresses and relatively large tolerances on circuit board thickness and hole size.

In addition to the plastic retention posts normally used for retaining SIMM sockets to circuit boards, other devices referred to generally as boardlocks are known for removably securing a socket-type electrical connector to a circuit board. The boardlocks typically have a first portion including means for engaging in the connector housing, and a second portion including means for engaging in a hole in the circuit board. While these devices are known in various configurations and are generally satisfactory for their intended use, it would be advantageous to have an improved boardlock that is tolerant of relatively large variations in circuit board dimensions.

The present invention provides a boardlock of simple yet robust construction which assures that a socket is retained fifthly to a circuit board in spite of relatively large discrepancies in circuit board thickness and hole size due to large manufacturing tolerances.

SUMMARY OF THE INVENTION

A boardlock according to the invention comprises an integral body including a main beam, a socket retention section adapted to self-retain to a socket, and a circuit board retention section engageable in a hole in a circuit board. The circuit board retention section is substantially flat and, together with at least the main beam, defines a plane. The circuit board retention section includes a pair of spaced apart legs extending in the plane from the main beam to a common remote end defined by a tie bar. The legs are dimensioned to extend beyond an exit of the hole at a far side of the circuit board. Portions of the legs are divergently angled as they extend to a widest dimension of the circuit board retention section. The widest dimension is chosen to be wider than a widest dimension of the hole exit in the circuit board, and to be spaced from the main beam by a distance greater than a thickness of the circuit board at a periphery of the hole exit. Further portions of the legs are convergently angled as they extend from the widest dimension to the remote end. The structural arrangement of the circuit board retention section makes it compliant substantially exclusively in the direction of the plane, and the divergently angled leg portions are spring biased against the periphery of the hole exit through a range of board thickness and hole diameter variations.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, wherein.

DETAILED DESCRIPTION OF THE PREFERRED EMBODIMENT

Figure 1:
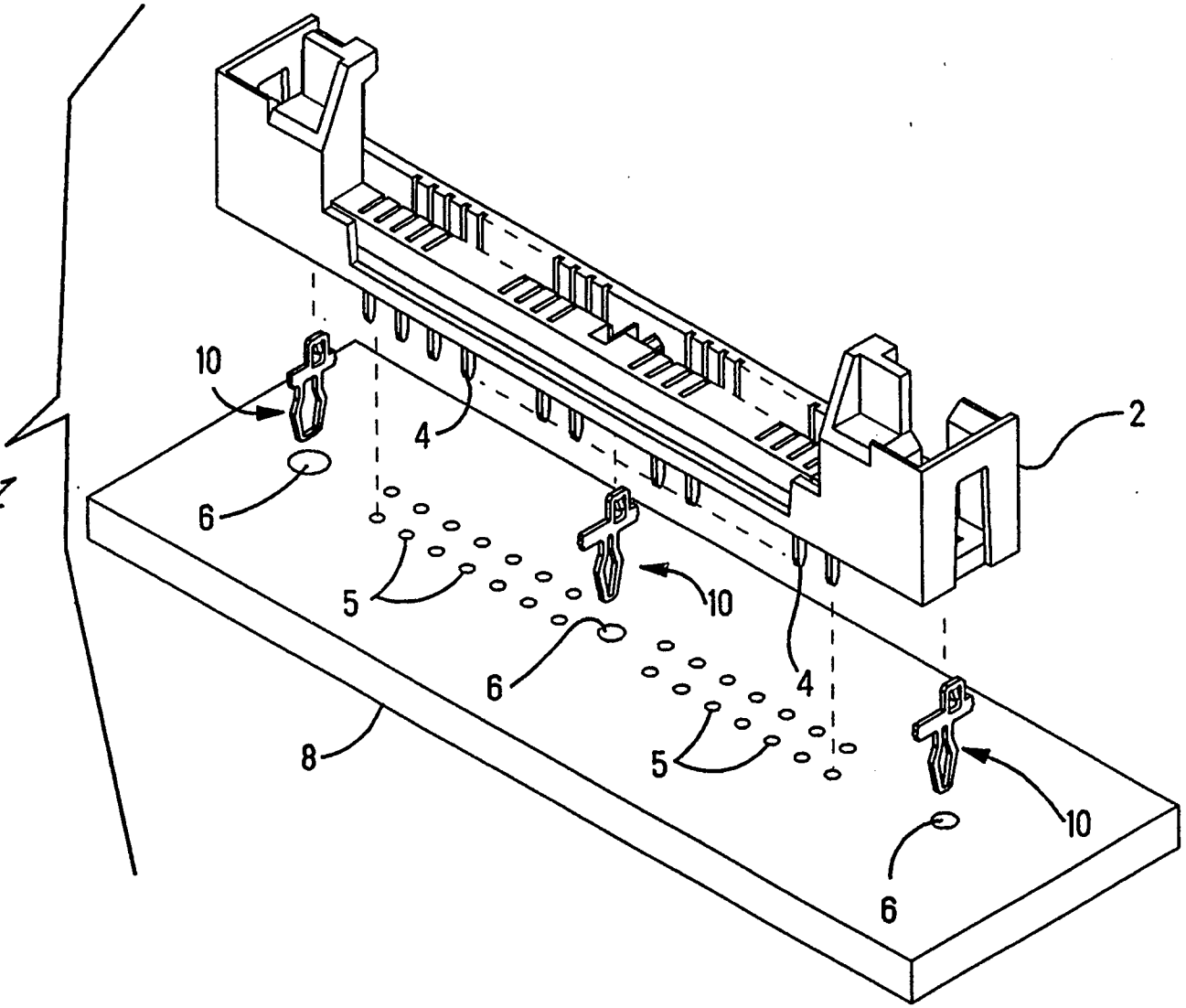
FIG. 1 is an exploded perspective view of a socket retained to a circuit board by boardlocks according to the invention.

A boardlock according to the invention is useful for retaining an electrical connector, particularly a single in-line memory module (SIMM) socket 2 as shown in FIG. 1, to a circuit board 8 or other substrate. The socket 2 has parallel rows of electrical leads 4 that must be connected to circuit traces on the circuit board 8. The leads 4 may be either posts (shown) defining solder tails which are received in through-holes 5 in the circuit board, or feet (not shown) which are surface mount soldered to contact pads on the circuit board. The present invention is useful with sockets 2 having either type of the electrical leads 4. The invention provides a boardlock, designated generally by reference numeral 10, which engages in a through-hole 6 in the circuit board 8 with a positive snap-action to bias the socket 2 against the circuit board and ensure that all of the leads 4 are fully seated in or on their respective circuit contacts.

Figure 2:
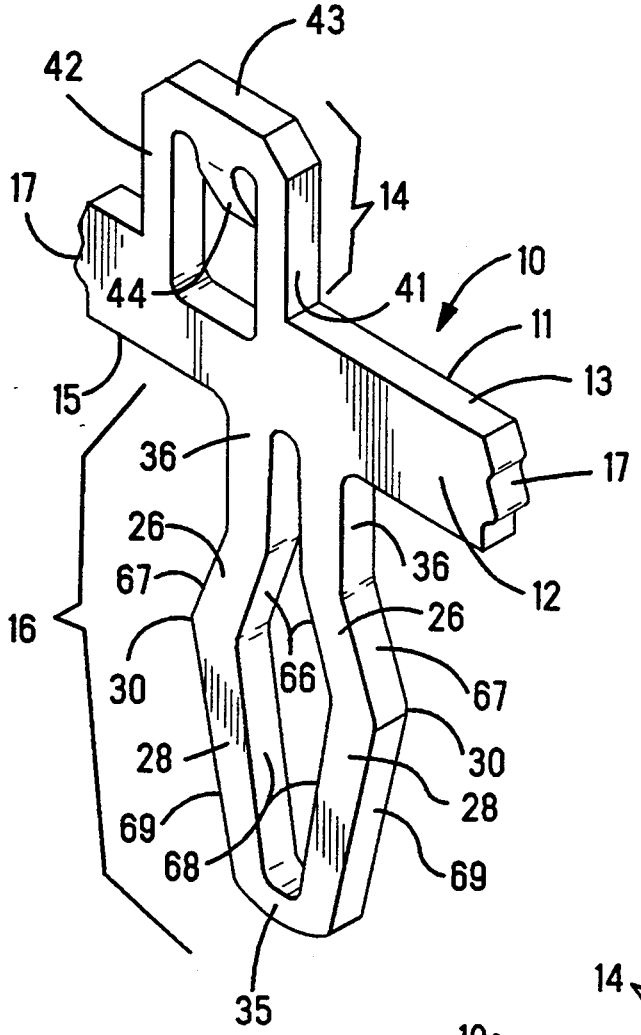
FIG. 2 is a perspective view of a boardlock according to the invention.
Figure 3:
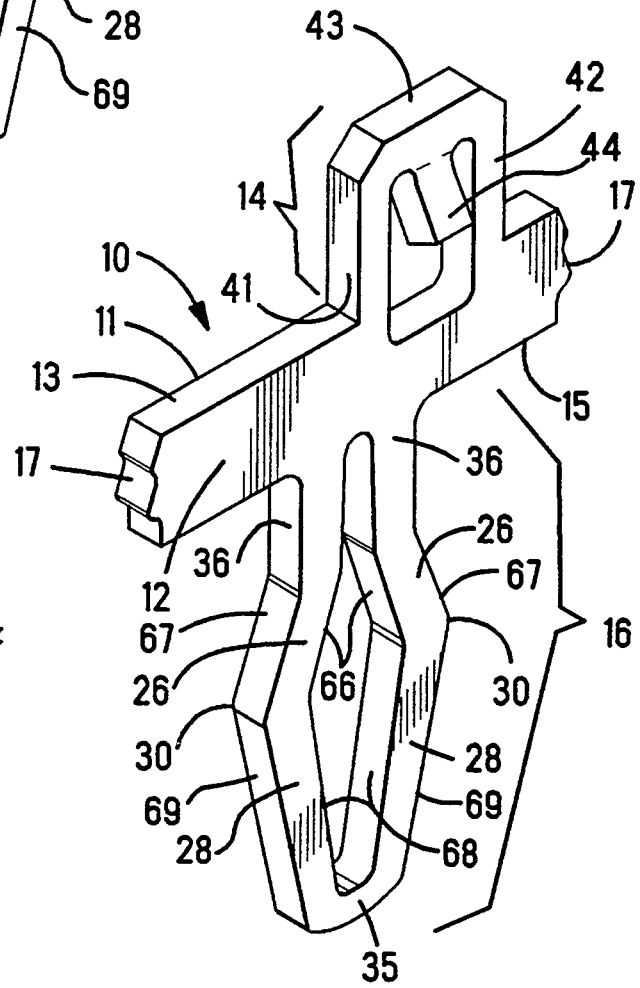
FIG. 3 is a perspective view of a reverse side of the boardlock shown in FIG. 2.
Figure 5:
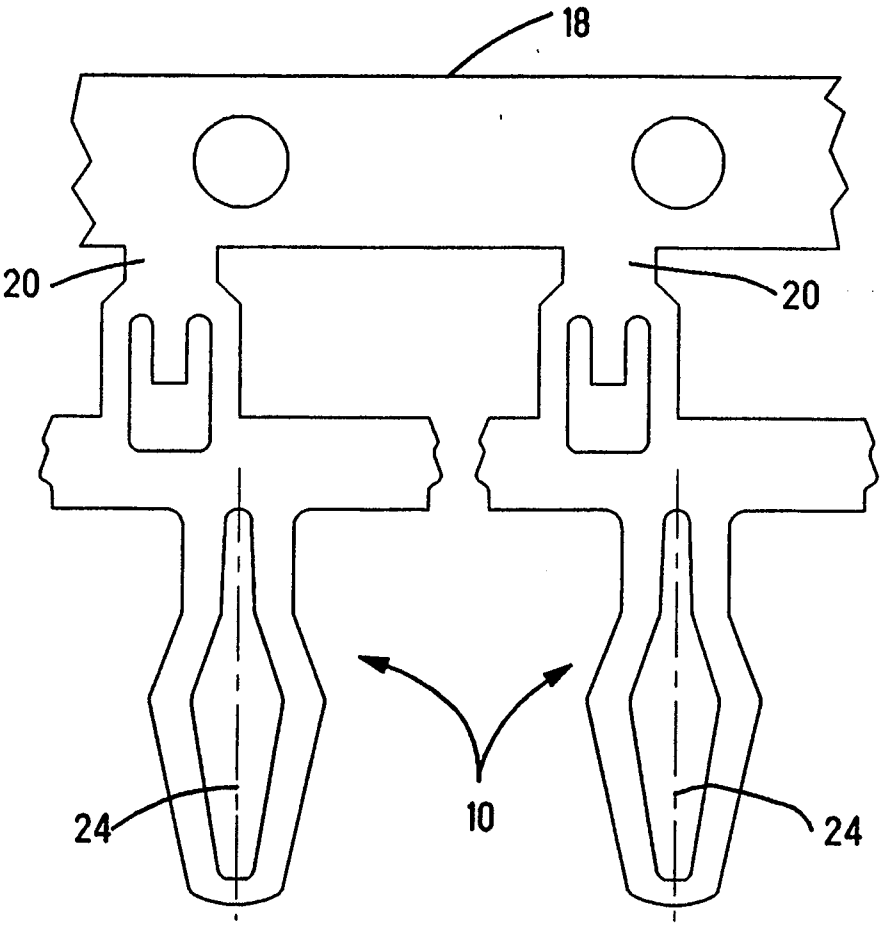
FIG. 5 is a plan view showing boardlocks attached to a carrier strip prior to being severed therefrom.
Figure 4:
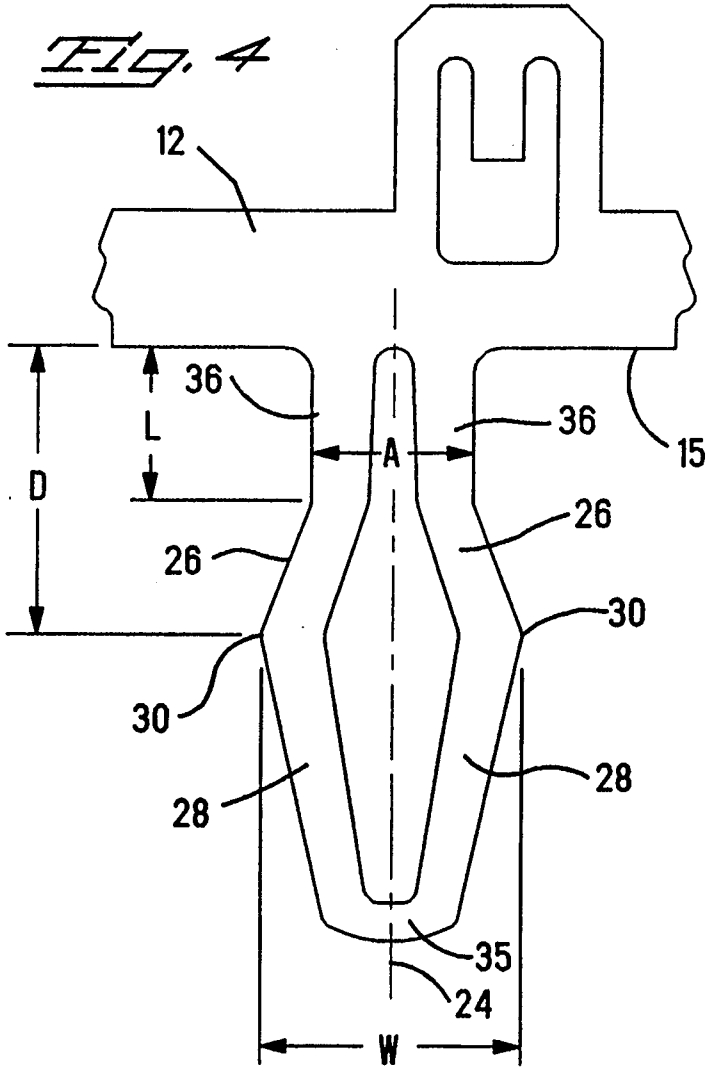
FIG. 4 is a plan view of the boardlock shown in FIG. 3.

A boardlock 10 according to the invention as shown in FIGS. 2–4 comprises an integral body 11 including a main beam 12, a socket retention section 14 and a circuit board retention section 16. The integral body 11 is made from flat sheet material and is preferably manufactured in a continuous stamping process from a 0.012 inch thick strip of phosphor bronze such that a plurality of the boardlocks 10 are formed along an indefinitely long carrier strip 18, as shown in FIG. 5. Other thicknesses and/or materials could be used in order to adjust spring characteristics of the boardlock, facilitate manufacture, and reduce costs. The boardlocks 10 are joined to the carrier strip 18 by connecting portions 20 which are severed prior to inserting individual ones of the boardlocks into complementary pockets in the socket 2. The integral body 11 is substantially flat and, as shown in FIGS. 2 and 3, after being separated from the carrier strip 18 the body 11 lies substantially in a plane.

In the preferred embodiment of the boardlock as shown in FIGS. 2–4, the socket retention section 14 includes vertical members 41, 42 and crossmember 43. A tab 44 depending from the crossmember 43 is bent outwardly of the plane of the frame 45 during the forming of the body 11.

The main beam 12 is partially defined by top edge 13, bottom edge 15, and ends 17. The ends 17 are jagged or serrated in order to assist in retaining the boardlock 10 in the socket 2 as will be more fully described hereinafter.

Figure 6:
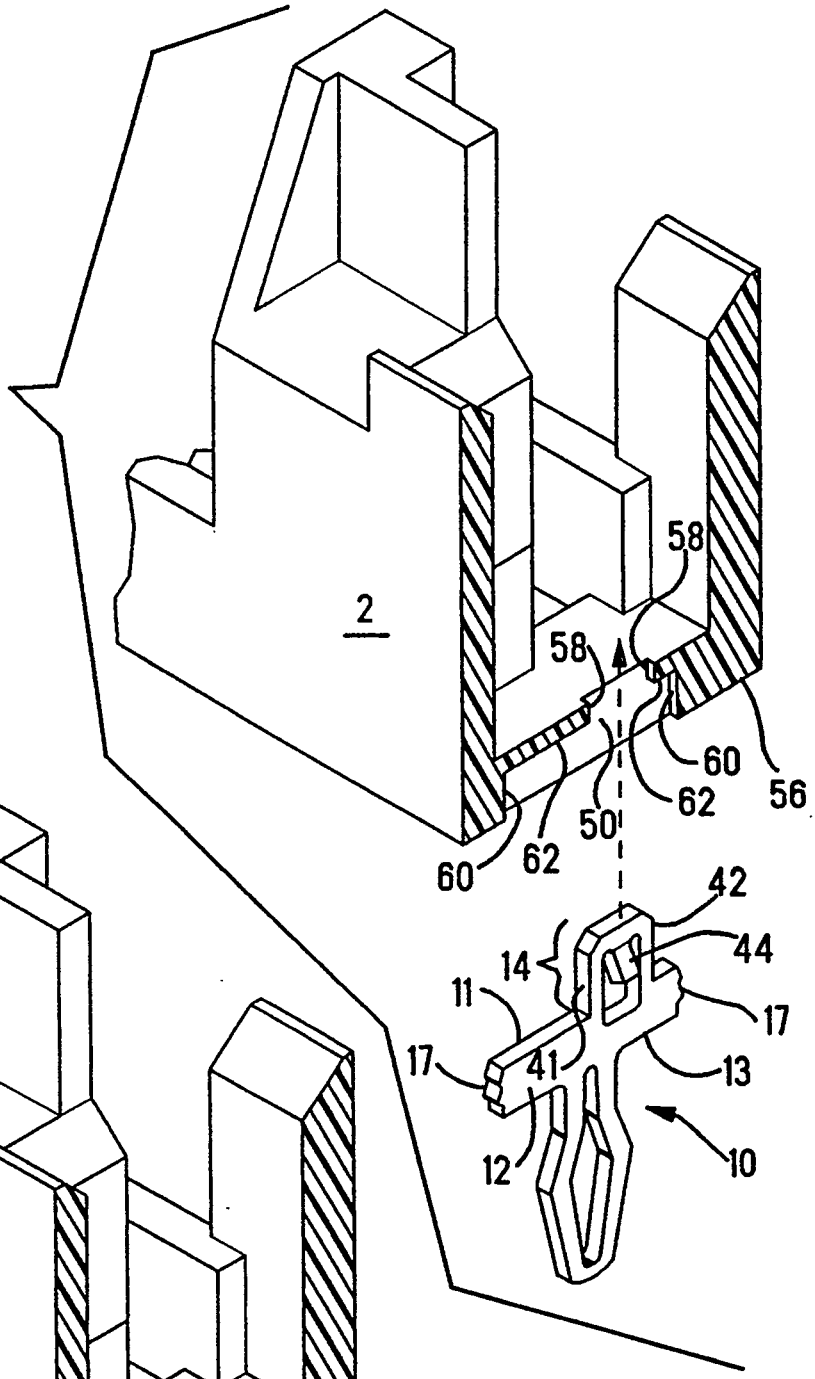
FIG. 6 is a perspective view showing a cross-section through a socket, and a boardlock prior to insertion in a reception cavity in the socket.
Figure 7:
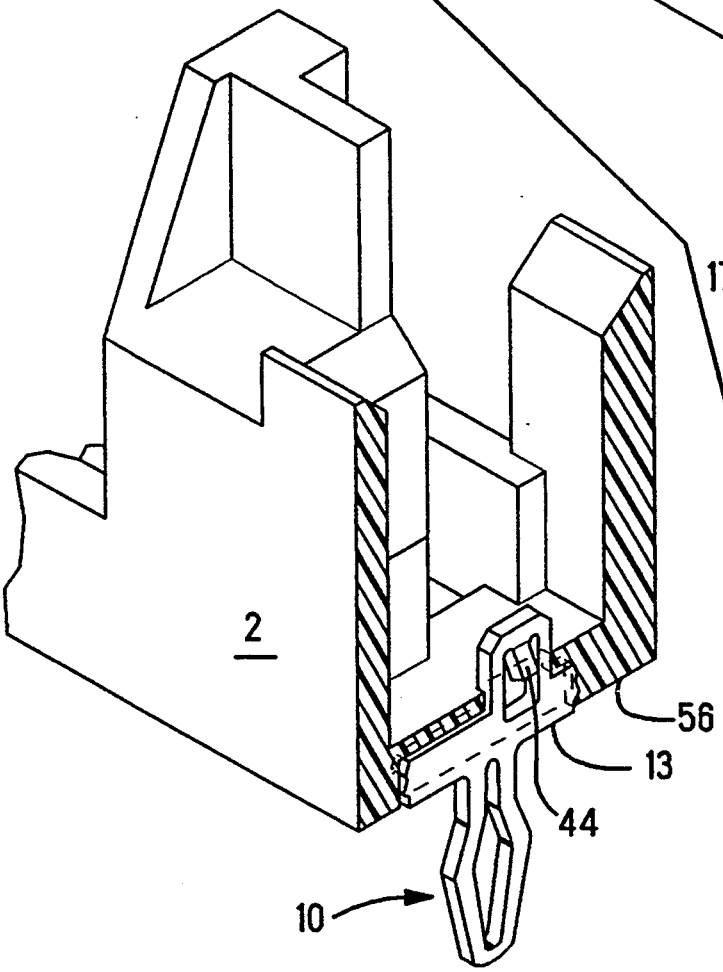
FIG. 7 is a cross-sectional view through a socket having a boardlock engaged therein.
Figure 11:
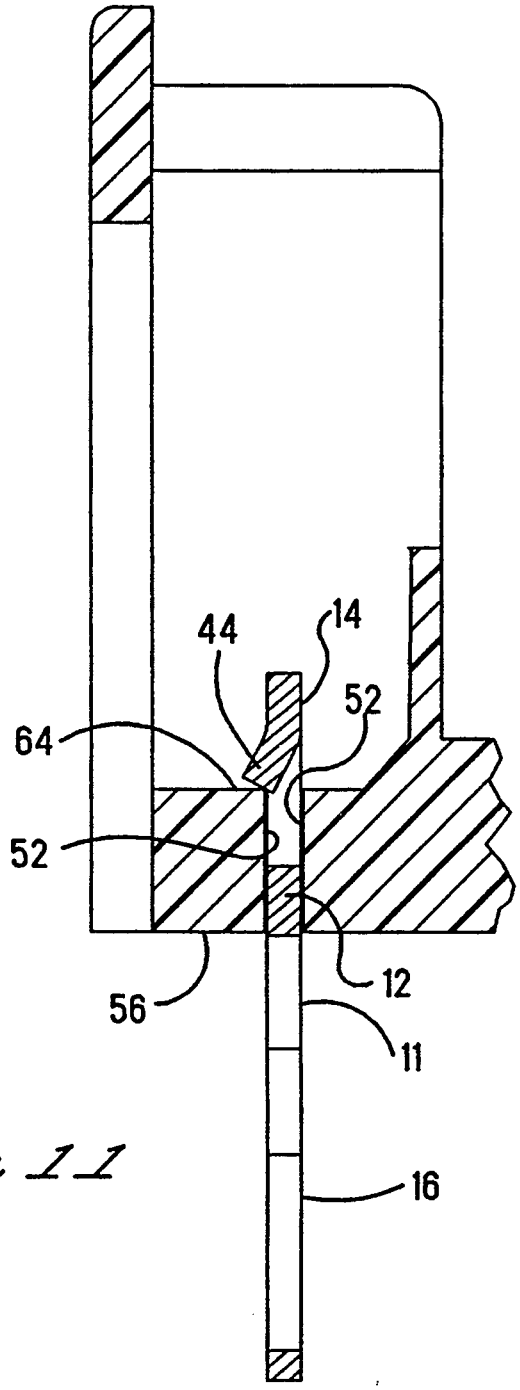
FIG. 11 is a cross-sectional view taken along line 11—11 of FIG. 10.

FIGS. 6, 7 and 11 illustrate cross-sections through a portion of the socket 2. As shown in the drawings, the socket 2 includes at least one slot 50 which is only slightly wider than the thickness of the material from which the boardlock is stamped. The slot 50 is defined by endwalls 58 and 60, transition walls 62, and side walls 52. The slot 50 is specially adapted to cooperate with the socket retention section 14 of the body 11 to self-retain the boardlock 10 to the socket. The socket 2 preferably includes three of the slots 50 at spaced apart locations along the length of the socket for receiving three of the boardlocks 10, one boardlock at a mid-portion of the socket and one at each end, as shown in FIG. 1.

As shown in FIG. 6, the socket retention section 14 of the boardlock is insertable through the slot 50 from a bottom 56 of the socket 2. The endwalls 58 and 60 are dimensioned to closely encompass the vertical members 41 and 42 of the socket retention section 14. As shown in FIGS. 7 and 11, when the socket retention section 14 is fully inserted into the slot 50, the outwardly bent tab 44 engages a ledge 64 defined above one of the side walls 52 of the slot 50, thereby preventing withdrawal of the boardlock 10 from the bottom of the socket 2.

A major portion of the slot 50 delineated by endwalls 60 and transition walls 62 is adapted to house the main beam 12 of the body 11 so that the bottom edge 15 of the main beam 12 is substantially flush with the bottom surface 56 of the socket 2 when the boardlock is engaged in the socket. The endwalls 60 are dimensioned for an interference fit with the ends 17 of the main beam 12, whereby ridges or teeth defined by the ends 17 engage in the endwalls 60 and grip the plastic housing of the socket 2. The ends 17 also provide stability of the boardlock in the housing and prevent angular displacement of the boardlock in the housing during handling of the socket and mounting of the socket on the circuit board.

Depending on the orientation of the slot 50 in the socket, the socket retention section 14 may be bent out of the plane of the body 11, for example, at a right angle to the body 11, as required to mate the socket to the circuit board. In any event, at least the main beam 12 and the circuit board retention section 16 define a plane of the body 11.

Referring now to FIGS. 2–4 and 8–10, the circuit board retention section 16 includes a pair of spaced apart legs 22 which are insertable into through-hole 6 in the circuit board 8 to retain the socket to the circuit board. The legs 22 are flat profiled members that extend in the plane of the body 11 on opposite sides of a longitudinal axis 24 from fixed origins 33, 34 on the main beam 12. The legs 22 terminate at a common remote end defined by a tie bar 35 which preferably has a slight curvature in the plane of the body 11. When the legs 22 are fully inserted into the through-hole 6, the axis 24 becomes coincident with the axis of the through-hole, and portions of the legs extend beyond an exit of the through-hole at a far side of the circuit board.

In order to effect capture of the circuit board by the circuit board retention section 16, the legs 22 have a widest dimension W in the plane of the body 11 and perpendicular to the axis 24 that is wider than a widest dimension of the hole exit. The widest dimension W is defined by portions of the legs that extend beyond the exit of the hole, the widest dimension W being spaced from the main beam 12 by a dimension D greater than the board thickness, thereby allowing capture of the board between the main member 12 and the widest dimension W.

More specifically, the legs 22 include divergently angled portions 26 joined to convergently angled portions 28 at vertices 30 which define the widest dimension W therebetween. The divergently angled portions 26 have respective pairs of inner edges 66 and outer edges 67 which are divergently angled as the portions 26 extend to the vertices 30. The convergently angled portions 28 have respective pairs of inner edges 68 and outer edges 69 which are convergently angled as the portions 28 extend from the vertices 30 to the remote end at the tie bar 35. In the preferred embodiment, the legs 22 also include initial portions 36 having length L that extend from the origins 33, 34 in a direction parallel to the axis 24 and which join the divergently angled portions 26.

The legs 22 are dimensioned according to the thickness of the circuit board 8 and the diameter of the through-hole 6 in which the boardlock is to engage. Dimensions of the legs 22 are selected such that, when the legs 22 are fully inserted in the through-hole, the divergently angled portions 26 are spring biased a periphery 7 of the hole exit. By properly selecting dimensions of the legs 22, the circuit board retention section 16 can be made to accommodate circuit boards having a wide range of board thickness and hole diameter variations.

By way of example, for a circuit board having a standard thickness of 0.062 inch plus or minus 0.008 inch, it has been found that a length L of 0.047 inch and a dimension D of 0.085 inch are advantageous for assuring that the divergently angled portions 26 will be disposed laterally adjacent to the periphery 7 of the hole exit through a range of board thickness variations.

Additionally, dimension A of the initial portions 36, and the widest dimension W of the legs 22, are selected according to the hole diameter. For a having nominal diameter of 0.064 inch, which typically has a manufacturing tolerance of plus or minus 0.004 inch, it has been found that a dimension A of 0.047 inch and a dimension W of 0.076 inch are advantageous for assuring that the divergently angled portions 26 will be spring biased against the periphery 7 of the hole throughout the range of hole diameter variations caused by manufacturing tolerances.

Figure 10:
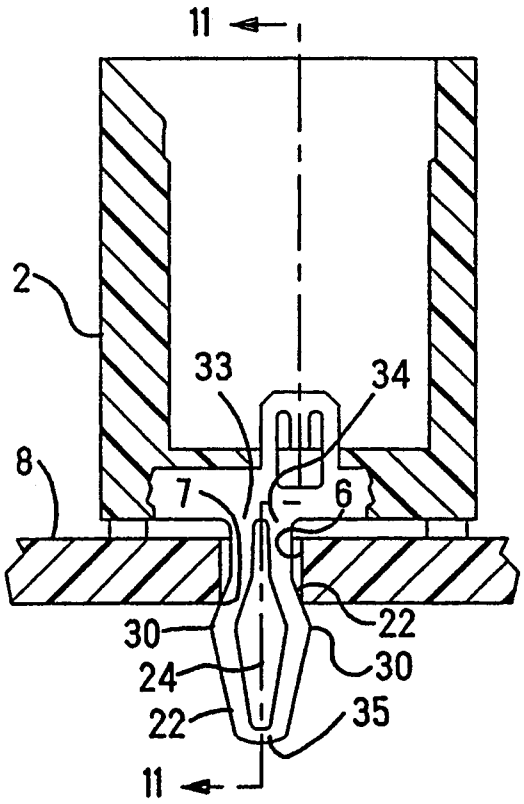
FIG. 10 is a cross-sectional view showing a socket having a boardlock fully inserted in a circuit board.
Figure 9:
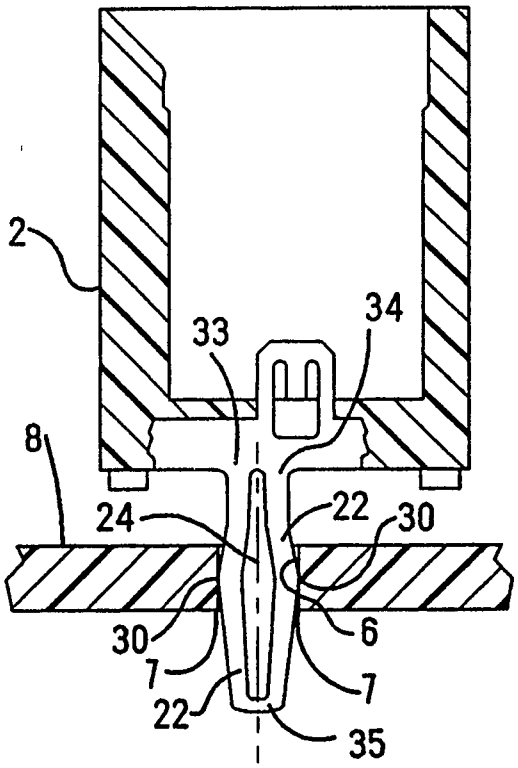
FIG. 9 is a cross-sectional view showing a socket having a boardlock partially inserted in a circuit board.
Figure 8:
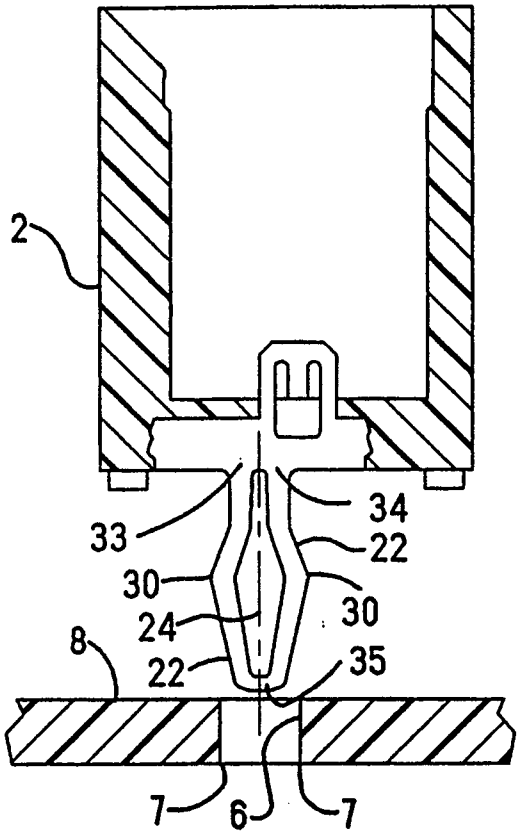
FIG. 8 is a cross-sectional view showing a socket having a boardlock engaged therein and disposed for mounting on a circuit board.

The tie bar 35 acts as a stiffener and enhances the mechanical properties of the circuit board retention section 16, particularly in the direction of the plane defined by the body 11. As shown in FIGS. 9 and 10, insertion of the legs 22 into the through-hole 6 deflects the legs inwardly toward the axis 24 against resistance offered by the tie bar 35, thereby increasing the curvature of the tie bar as the legs are brought closer together. When the legs are inserted sufficiently for the vertices 30 to emerge beyond the hole exit, the tie bar 35 urges the legs 22 to reside outwardly from the axis 24 with a snap action that draws the legs 22 fully into the through-hole 6 until the socket 2 contacts the circuit board 8. In this position, the divergently angled portions 26 are biased against the periphery 7 of the hole exit, thereby holding the socket 2 firmly against the circuit board 8 so that the leads 4 of the socket are in mating engagement with their respective circuit traces. During insertion of the circuit board retention section 16 into the through-hole 6, the legs 22 are compliant substantially exclusively in the plane defined by the body 11.

In order to polarize the socket with respect to the circuit board, the through-holes 6 associated with respective opposite ends of the socket 2 may have different diameters, thus necessitating that boardlocks having different dimensions W be utilized to engage in the differently dimensioned holes.

A boardlock according to the invention has a simple construction making it relatively inexpensive to manufacture. The tie bar 35 improves compliancy and stress distribution in the legs 22, and increases the retention force holding the boardlock in the circuit board. The boardlock has the advantage that it exerts a high retention force on the circuit board over a broad range of board thickness and hole diameter variations.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A boardlock for an electrical socket, comprising:

a substantially flat integral body lying substantially entirely within a plane and including a socket retention section adapted to self-retain to the socket, and a depending circuit board retention section insertable into a hole in a circuit board and dimensioned to extend beyond an exit of the hole, the integral body being adapted to retain the socket to the circuit board upon board mounting, the circuit board retention section including a pair of legs extending in the plane from fixed origins which are spaced apart along the body until they join together again at a common remote end defined by a tie bar, portions of the legs having respective pairs of inner and outer edges which are divergently angled as the portions extend to a widest dimension of the circuit board retention section, the widest dimension being wider than a widest dimension of the hole exit in the circuit board, the widest dimension being spaced from the fixed origins by a dimension greater than a thickness of the circuit board at a periphery of the hole exit, further portions of the legs having respective pairs of inner and outer edges which are convergently angled as the further portions extend from the widest dimension toward the remote end, wherein the circuit board retention section is compliant substantially exclusively in the direction of the plane and the divergently angled leg portions are spring biased against the periphery of the hole exit through a range of board thickness and hole diameter variations.

2. The boardlock according to claim 1, wherein the socket retention section is insertable between walls of a slot defined by the socket, and the socket retention section includes a tab bent outwardly of the plane for engaging a ledge defined by one of the walls.

3. The boardlock according to claim 1, wherein initial portions of the legs between the fixed origins and the divergently angled portions extend parallel to each other.

4. The boardlock according to claim 1, wherein each of the legs has a uniform width in the plane as said each leg extends between its respective fixed origin and the common remote end.

5. A boardlock for an electrical socket, comprising:

an integral body including a main beam, a socket retention section extending from the main beam and adapted to self-retain to the socket, and a substantially flat circuit board retention section depending from the main beam and insertable into a hole in a circuit board and dimensioned to extend beyond an exit of the hole, at least the main beam and the circuit board retention section lying substantially entirely within a plane, the integral body being adapted to retain the socket to the circuit board upon board mounting, the circuit board retention section including a pair of spaced apart legs extending in the plane from the main beam until they join together again at a common remote end defined by a tie bar, portions of the legs having respective pairs of inner and outer edges which are divergently angled as the portions extend to a widest dimension of the circuit board retention section, the widest dimension being wider than a widest dimension of the hole exit in the circuit board, the widest dimension being spaced from the main beam by a distance greater than a thickness of the circuit board at a periphery of the hole exit, further portions of the legs having respective pairs of inner and outer edges which are convergently angled as the further portions extend from the widest dimension toward the remote end, wherein the circuit board retention section is compliant substantially exclusively in the direction of the plane and the divergently angled leg portions upon being board mounted are spring biased against the periphery of the hole exit through a range of board thickness and hole diameter variations.

6. The boardlock according to claim 5, wherein the socket retention section is insertable between walls of a slot defined by the socket, and the socket retention section includes a tab bent outwardly of the plane for engaging a ledge defined by one of the walls.

7. The boardlock according to claim 5, wherein initial portions of the legs between the fixed origins and the divergently angled portions extend parallel to each other.

8. The boardlock according to claim 5, wherein each of the legs has a uniform width in the plane as said each leg extends between its respective fixed origin and the common remote end.

* * * * *